United States Patent [19]

Engelfried et al.

[11] Patent Number: 4,862,709

[45] Date of Patent: Sep. 5, 1989

[54] STITCH-FORMING KNITTING MACHINE

[75] Inventors: Werner Engelfried, Sindelfingen; Gerhard Müller, Esslingen, both of Fed. Rep. of Germany

[73] Assignee: Terrot Strickmaschinen GmbH, Stuttgart, Fed. Rep. of Germany

[21] Appl. No.: 197,462

[22] Filed: May 23, 1988

[30] Foreign Application Priority Data

May 26, 1987 [DE] Fed. Rep. of Germany ..... 3717673

[51] Int. Cl.[4] ..... D04B 15/06; D04B 15/24

[52] U.S. Cl. ..... 66/104; 66/115

[58] Field of Search ..... 66/104, 107, 108 R, 66/108 A, 115

[56] References Cited

U.S. PATENT DOCUMENTS

| | | | |
|---|---|---|---|
| 925,036 | 6/1909 | Scott | 66/107 |
| 1,255,258 | 2/1918 | Wilcomb | 66/107 X |
| 1,678,386 | 7/1928 | Grothey | 66/107 X |
| 2,057,436 | 10/1936 | Lawson | 66/108 R |
| 2,090,500 | 8/1937 | Lawson | 66/107 |
| 4,574,596 | 3/1986 | Engelfried et al. | 66/104 |
| 4,608,841 | 9/1986 | Buck et al. | 66/104 |

FOREIGN PATENT DOCUMENTS

| | | | |
|---|---|---|---|
| 2311658 | 9/1975 | Fed. Rep. of Germany | 66/107 |
| 2057021 | 3/1981 | United Kingdom | 66/107 |

*Primary Examiner*—Wm. Carter Reynolds
*Attorney, Agent, or Firm*—Shenier & O'Connor

[57] ABSTRACT

On a stitch-forming machine having knitting needles, knocking-over sinkers and controlling sinkers, in addition to their mutual articulated connection, the knocking-over and controlling sinkers are also connected to each other for mutual longitudinal displacement. Contiguous sliding surfaces are provided on the sinkers so as to slide on one another and bring about tilting motion of the knocking-over sinkers during mutual longitudinal displacement of the sinkers. Return parts are also provided for returning the tilted knocking-over sinkers to their initial position.

7 Claims, 4 Drawing Sheets

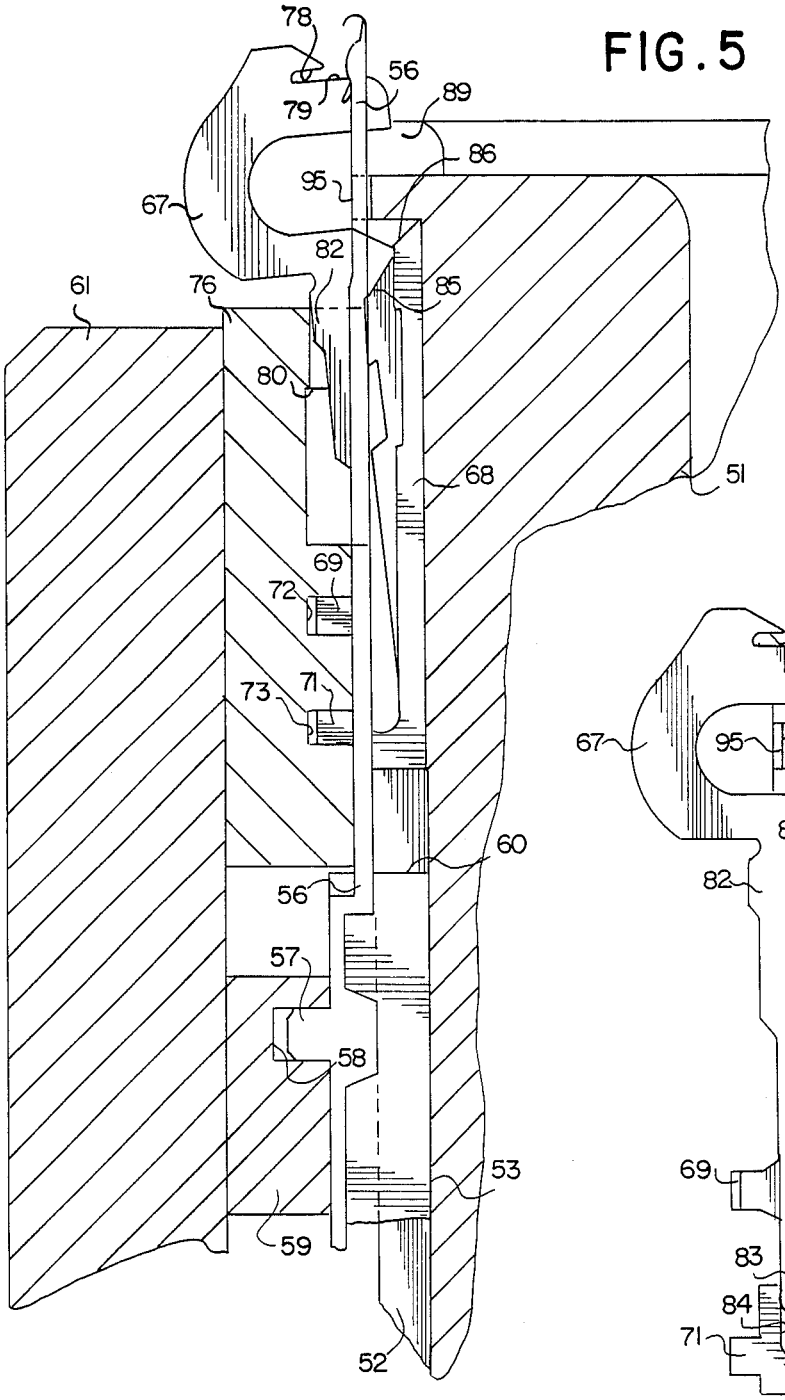
FIG. 5
FIG. 6
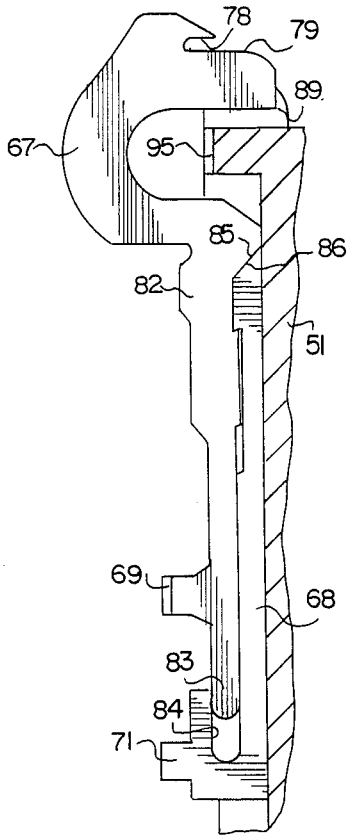

STITCH-FORMING KNITTING MACHINE

The invention relates to a stitch-forming machine with a needle carrier, with stitch-forming needles guided in a longitudinally displaceable manner on the needle carrier, with cam parts for controlling the needles, with a sinker carrier, with knocking-over sinkers which are guided in a longitudinally displaceable and tiltable manner on the sinker carrier and which cooperate with the needles, with controlling sinkers which are guided in a longitudinally displaceable manner only on the sinker carrier and which are articulatedly connected with the knocking-over sinkers, and with cam parts for controlling the knocking-over and controlling sinkers.

In a known machine of this kind—DE-OS (German unexamined patent application) 3 321 385, corresponding to U.S. Pat. No. 4,574,596 —the needles and the knocking-over sinkers may cause irregularities in the stitch formation particularly at high rotational speeds. The noise level in the known machine is also relatively high on account of the friction which occurs.

The object of the invention is to improve the means for controlling the tilting of the knocking-over sinker in order to achieve greater operational reliability and a low noise level.

The object is accomplished in accordance with the invention by the knocking-over and controlling sinkers also being connected to each other for mutual longitudinal displacement in addition to their mutual articulated connection, by contiguous sliding surfaces being provided on the knocking-over and controlling sinkers so as to slide on one another and cause the tilting motion of the knocking-over sinkers during mutual longitudinal displacement of the knocking-over and controlling sinkers, and by return parts being provided for returning the tilted knocking-over sinkers to their initial position.

Figure 1:
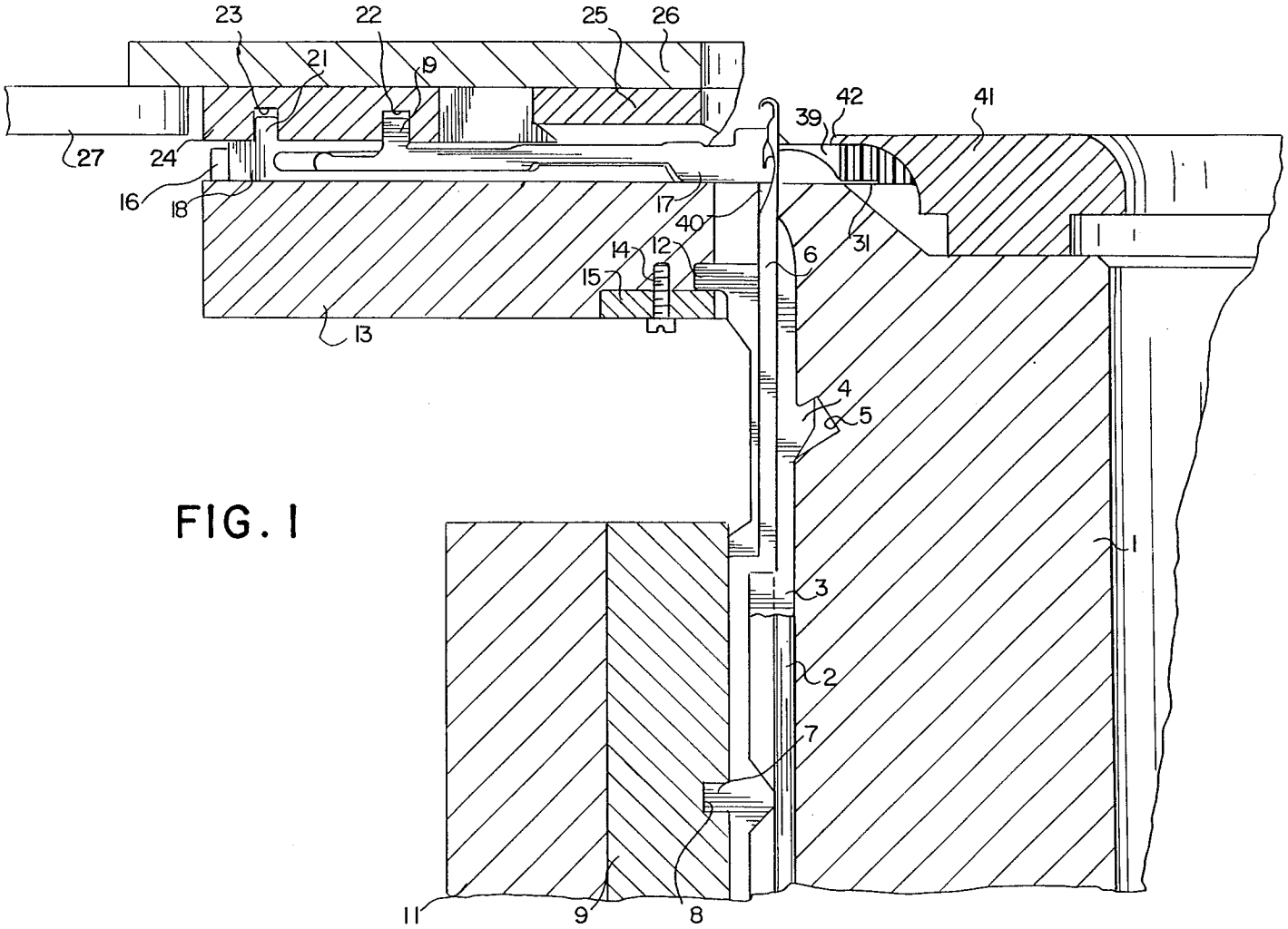
Figure 2:
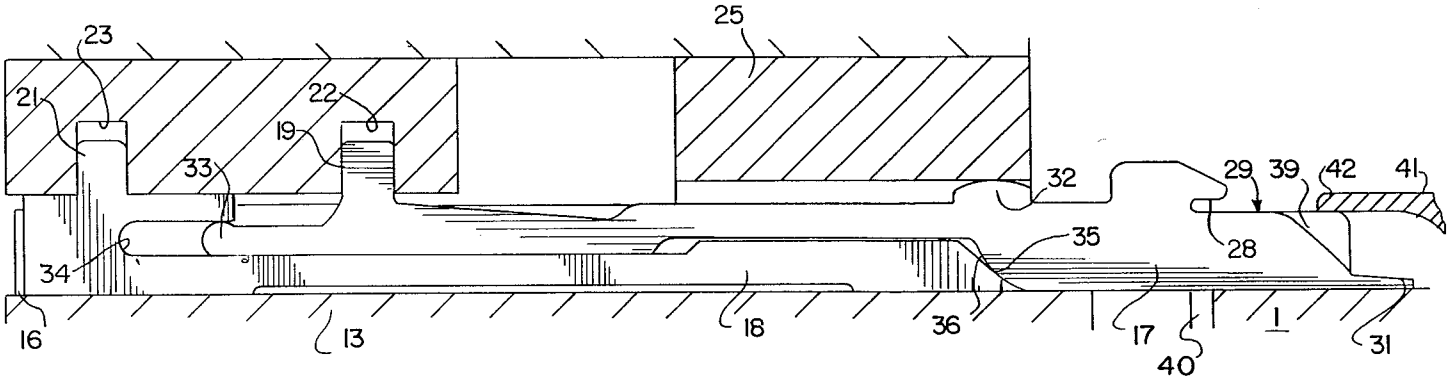
Figure 3:
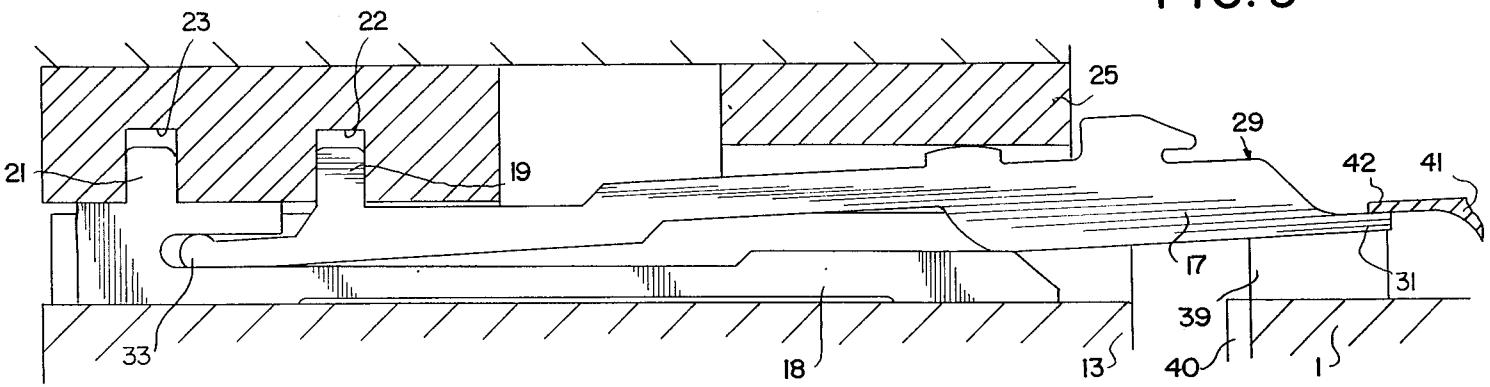
Figure 4:
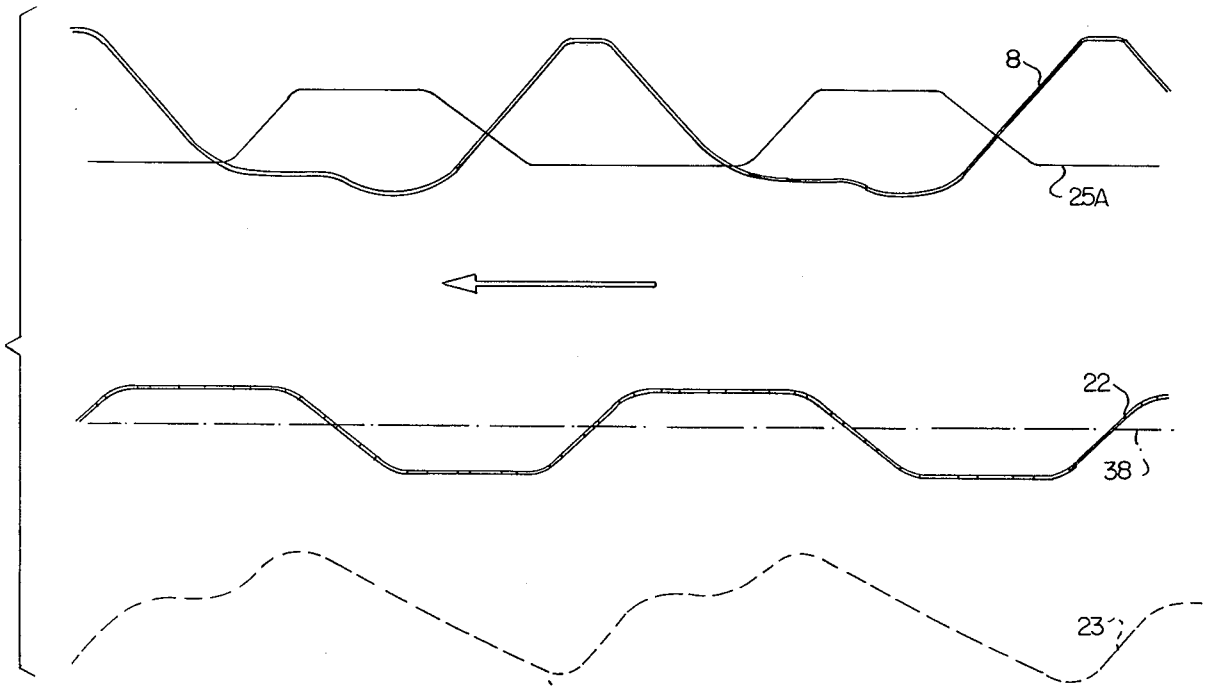

The following description of preferred embodiments serves in conjunction with the appended drawings to explain the invention in greater detail. The drawings show:

FIG. 1 a schematic sectional view of a needle cylinder with sinker ring;

FIGS. 2 and 3 two different positions of knocking-over and controlling sinkers;

FIG. 4 cam curves associated with FIGS. 2–3 for the controlling of the needles and sinkers;

FIG. 5 a schematic sectional view of a needle cylinder in another embodiment of the invention; and FIG. 6 a partial view similar to FIG. 5 with the sinkers in a different position.

In the first embodiment of the invention illustrated in FIGS. 1 to 4, longitudinal slots 2 are formed on the outer circumference of a conventional needle cylinder 1 which is rotatingly driven about its axis. Webs 3 are secured adjacent to one another in a similarly conventional manner in longitudinal slots 2. Projections 4 on webs 3 engaging a circumferential groove 5 in cylinder 1 serve to secure webs 3 in longitudinal slots 2. Knitting needles 6 are mounted for reciprocating motion in a manner known per se in the longitudinal slots formed by webs 3. Knitting needles 6 are provided with controlling butts 7 which engage groove-shaped cam tracks or control cams 8 on cam parts 9. Cam parts 9 are arranged on a cam ring 11 which is held in a stationary manner. When needle cylinder 1 rotates relative to cam ring 11, needles 6 move up and down in accordance with the course of the control cam 8. The course of the needle cam track 8 is illustrated in plane development in FIG. 4.

At least some of webs 3 have lugs 12 protruding radially outwardly beyond the contour of cylinder 1. A sinker ring 13 is mounted in a conventional manner by means of screws 14 and holding parts 15 on lugs 12 in such a way that ring 13 rotates together with cylinder 1. A knocking-over sinker 17 and a controlling sinker 18 are mounted in a slidingly displaceable manner in radially extending slots 16 of sinker ring 13 which in FIG. 1 are open in the upward direction. Both sinkers 17, 18 have controlling butts 19 and 21, respectively, which engage groove-shaped cam tracks or control cams 22 and 23, respectively, on a sinker cam part 24. Cam part 24 is fixedly arranged together with a further return part 25, described below, on a sinker cam 26 which is adjustable by means of a carrier 27 in both the vertical direction relative to sinker ring 13 and the direction of motion relative to cam ring 11. When sinker ring 13 rotates relative to sinker cam 26, a radially reciprocating motion is imparted to sinkers 17, 18 due to engagement of their butts 19, 21 in control grooves 22, 23. The course of control cams 22, 23 is illustrated schematically in plane development in FIG. 4. The directions of displacement of needles 6 and sinkers 17, 18 preferably include an angle of 90 degrees.

FIGS. 2 and 3 show two extreme positions and also the shape in detail of the knocking-over and controlling sinkers 17 and 18, respectively. The knocking-over sinker 17 comprises in the conventional manner a holding-down throat 28 for holding down semi-finished courses in order to prevent a knitted article from being taken along when needles 6 are driven out. The knocking-over sinker 17 is also provided with the conventional knock-over edge 29 and with a projection 31, the function of which will be explained below. A projection 32 of spherical configuration protruding from the rear side of knocking-over sinker 17 cooperates with return part 25, also called lowering cam. The end of knocking-over sinker 17 opposite projection 31 has a round portion 33 of increased thickness which constitutes an axis of tilt.

The controlling sinker 18 extends within slot 16 in sinker ring 13 substantially below knocking-over sinker 17. In the vicinity of the thicker portion 33, it has a slot-shaped recess 34 which extends parallel to the axis of slot 16 and encloses the thicker portion 33 in such a way that this thicker portion is slidingly displaceable and, in addition, tiltable in recess 34 (FIG. 3). It will be seen that portion 33 is recess 34 provides an articulated connection between knocking-over sinker 17 and controlling sinker 18.

The knocking-over sinker 17 has a slightly rounded sliding surface 35 which extends essentially at an incline to the longitudinal extension of the sinker and cooperates with a corresponding sliding surface 36 at the front end of controlling sinker 18. In FIG. 2, the two sliding surfaces 35, 36 are resting against one another. When, as shown in FIG. 3, sinkers 17, 18 are displaced towards each other in the longitudinal direction due to the course of control cams 22, 23, in which case, the thicker portion 33 of sinker 17 is displaced in recess 34 of sinker 18, surfaces 35, 36 slide up one another and cause tilting motion of knocking-over sinker 17, whereby knock-over edge 29 is moved in the opposite direction of needle 1 moving downwards at this instant (see FIG. 5), as is desired in the so-called contrary knitting technique (motion in opposite directions).

The surface contour of return part 25 at the bottom in FIGS. 1 to 3 is designed in such a way that the knocking-over sinker 17 is necessarily returned from the tilted position shown in FIG. 3 to the initial position shown in FIG. 2 via projection 32 formed on knocking-over sinker 17 when the two sinkers 17, 18 are pushed apart again in the longitudinal direction as shown in FIG. 2. The bottom surface contour of return part 25 is, of course, also of such design that return part 25 does not obstruct tilting motion of knocking-over sinker 17 when sinkers 17, 18 are moved into the position shown in FIG. 3.

The precisely timed coordination of the motion of needle 6 and sinkers 17, 18 is apparent from the previously mentioned FIG. 4 where curve 25A is the curve of vertical motion of the knock-over edge 29 of knocking-over sinker 17. For the purpose of clarification, the so-called "needle trick bottom", i.e., the bottom on which the needles rest, is also indicated by a dot-and-dash line 38 in FIG. 4.

At its end face located at the top in FIGS. 1 to 3, needle cylinder 1 terminates in a slotted comb ring 39, the slots of which are aligned with slots 2 in cylinder 1 and are offset in relation to the slots which are formed between webs 3 and guide needles 6. The front ends of knocking-over sinkers 17, likewise offset in relation to needles 6, engage the slots of comb ring 39, aligned with slots 16 of sinker ring 13, and continuous, lateral guidance is thereby imparted to them (see FIGS. 2 and 3). Further slots 40 formed on needle cylinder 1 and correspondingly offset in relation to the slots of comb ring 39 guide needles 6 laterally in the upper regions thereof (FIGS. 1, 2 and 3).

A ring 41 is, furthermore, provided on that end face of needle cylinder 1 which is located at the top in FIGS. 1 to 3. This ring 41 has two functions: Firstly, its outwardly protruding edge 42 serves as limit stop for projection 31 of the tilted knocking-over sinker 17 (FIG. 3) and, secondly, ring 41 guides the finished knitted article from needles 6 into the interior of cylinder 1.

The modified embodiment of a stitch-forming machine illustrated in FIGS. 5 and 6 differs basically from the embodiment shown in FIGS. 1 to 3 in that there is no separate sinker carrier (sinker ring 13) for the knocking-over and controlling sinkers, but instead a needle cylinder 51 serving as needle carrier and corresponding to cylinder 1 in the first embodiment is simultaneously sinker carrier.

Again, needle cylinder 51 comprises axially parallel longitudinal slots 52 on its outer circumference with webs 53 inserted in these. Knitting needles 56 are guided in a slidingly displaceable manner in the slots formed between webs 53 and by means of controlling butts 57 engage control cams 58 of a cam part 59 which is connected to a cam ring 61.

Webs 53 extend with their upper edge 60 only a short distance above cam part 59. Therefore, above this edge, the longitudinal slots 52 formed on cylinder 51 can accommodate in a slidingly displaceable manner, in laterally offset relation to needles 56, knocking-over and controlling sinkers 67 and 68, respectively, which are arranged above control cam 58. Controlling butts 69 and 71, respectively, protruding radially outwardly from these sinkers 67, 68 engage control grooves 72 and 73, respectively, on a sinker cam part 76 which is fixedly connected to cam ring 61. Accordingly, when cylinder 51 rotates relative to cam ring 61, motion, described in detail below, corresponding to the course of control cams 72, 73, is imparted to sinkers 67, 68.

The shape and arrangement of sinkers 67, 68 are clearly apparent from the illustrations in FIGS. 5 and 6. Again, the knocking-over sinker 67 with a holding-down throat 78 and a knock-over edge 79 has a rounded thicker portion 83 which constitutes an axis of tilt for sinker 67 and is guided in a longitudinally displaceable manner in a corresponding recess 84 of controlling sinker 68. It will be seen that portion 83 in recess 84 provides an articulated connection between knocking-over sinker 67 and controlling sinker 68. So far, this embodiment conforms with that shown in FIGS. 1 to 3. In further conformity, sinkers 67, 68 comprise sliding surfaces 85 and 86, respectively, which are associated with each other. During relative displacement of the two sinkers 67, 68 in the longitudinal direction, sliding surfaces 85 and 86 slide on one another and, as shown in FIGS. 5 and 6, cause knocking-over sinker 67 to be tilted out of the position shown in FIG. 6 into the position shown in FIG. 5.

A projection 80 which has a corresponding surface contour and is oriented radially inwardly extends right around sinker cam part 76 and acts as return part to return knocking-over sinker 67 from the position shown in FIG. 5 to the position shown in FIG. 6. Projection 80 engages an oppositely located projection 82 on sinker 67. As far as their design, arrangement and mode of operation are concerned, sinkers 67, 68 correspond to sinkers 17, 18, however, with the important difference that in the embodiment shown in FIGS. 5 and 6, the knocking-over and controlling sinkers are not guided in a separate sinker carrier (sinker ring 13) but in the needle carrier (needle cylinder 51).

A slotted comb ring 89 is provided on needle cylinder 51. Knocking-over sinkers 67 constantly engage the slots of comb ring 89, in alignment with slots 52, which gives knocking-over sinkers 67 lateral support.

In the vicinity of that end face of needle cylinder 51 which is located at the top in FIG. 5, slots 95 of lesser depth are milled on the outer wall of needle cylinder 51 and serve to laterally guide the top parts of needles 56. Slots 95 are correspondingly offset in relation to the horizontal slots of comb ring 89 which guide knocking-over sinkers 67.

The course of control cams 58, 72, 73 and the surface contour of return part 80 correspond to the curves illustrated in FIG. 4.

In all embodiments of the invention, needles 6, 56 may be designed as latch, spring beard, slide or tubular needles or they may take the form of other stitch-forming knitting implements.

The present disclosure relates to the subject matter disclosed in German Application No. P 37 17 673.0 of May 26, 1987, published Dec. 8, 1988, the entire specification of which is incorporated herein by reference.

What is claimed is:

1. A stitch-forming machine comprising a needle carrier, stitch-forming needles which are guided in a longitudinally displaceable manner on said needle carrier, cam parts for controlling said needles, a sinker carrier, knocking-over sinkers which are guided in a longitudinally displaceable and tiltable manner on said sinker carrier and which cooperate with said needles, controlling sinkers which are guided in a longitudinally displaceable manner only on said sinker carrier and which are articulatedly connected to said knocking-over sinkers, and cam parts for controlling said knocking-over and controlling sinkers, characterized in that in addition to their mutual articulated connection, said knocking-over and controlling sinkers (17, 18; 67, 68) are also connected to each other for mutual longitudinal displacement, in that contiguous sliding surfaces (35, 36; 85, 86) are provided on said knocking-over and controlling sinkers so as to slide on one another and cause the tilting motion of said knocking-over sinkers (17; 67) during mutual longitudinal displacement of said knocking-over and controlling sinkers, and in that return parts (25; 80) are provided for returning said tilted knocking-over sinkers to their initial position.

2. A machine as defined in claim 1, characterized in that said sinker carrier (13) guiding said knocking-over and controlling sinkers (17, 18) is separate from said needle carrier (1) and is secured at a specified angle to said needle carrier.

3. A machine as defined in claim 1, characterized in that said sinker carrier guiding said knocking-over and controlling sinkers (67,68) is simultaneously the needle carrier (51).

4. A machine as defined in claim 2, characterized in that said knocking-over sinkers (17, 67) are additionally guided in slots (39, 89) of said needle carrier (1, 51).

5. A machine as defined in claim 4, characterized in that said needles (56) guided between webs (53) on said needle carrier (51) are guided below said slots (89) guiding said knocking-over sinkers (67) in further slots (95) of said needle carrier which are offset in relation to said slots guiding said knocking-over sinkers (67).

6. A machine as defined in claim 3, characterized in that said knocking-over sinkers (17, 67) are additionally guided in slots (39, 89) of said needle carrier (1, 51).

7. A machine as defined in claim 6, characterized in that said needles (56) guided between webs (53) on said needle carrier (51) are guided below said slots (89) guiding said knocking-over sinkers (67) in further slots (95) of said needle carrier which are offset in relation to said slots guiding said knocking-over sinkers (67).

* * * * *